US008294662B2

(12) United States Patent
Yamazaki

(10) Patent No.: US 8,294,662 B2
(45) Date of Patent: Oct. 23, 2012

(54) ELECTRO-OPTICAL DEVICE, SCAN LINE DRIVING CIRCUIT, AND ELECTRONIC APPARATUS

(75) Inventor: Katsunori Yamazaki, Matsumoto (JP)

(73) Assignee: Sony Corporation, Tokyo (JP)

( * ) Notice: Subject to any disclaimer, the term of this patent is extended or adjusted under 35 U.S.C. 154(b) by 1102 days.

(21) Appl. No.: 11/976,175

(22) Filed: Oct. 22, 2007

(65) Prior Publication Data

US 2008/0136964 A1 Jun. 12, 2008

(30) Foreign Application Priority Data

Dec. 7, 2006 (JP) ..... 2006-330149

(51) Int. Cl.
*G09G 3/36* (2006.01)

(52) U.S. Cl. ..... 345/103; 345/100

(58) Field of Classification Search ..... 345/98–100, 345/103
See application file for complete search history.

(56) References Cited

U.S. PATENT DOCUMENTS 7,193,602 B2 * 3/2007 Morita ..... 345/100

FOREIGN PATENT DOCUMENTS

| | | |
|---|---|---|
| JP | A-02-312371 | 12/1990 |
| JP | A-07-294882 | 11/1995 |
| JP | A-08-327979 | 12/1996 |
| JP | A 2002-169518 | 6/2002 |

* cited by examiner

*Primary Examiner* — Chanh Nguyen
*Assistant Examiner* — Allison Walthall
(74) *Attorney, Agent, or Firm* — K&L Gates LLP

(57) ABSTRACT

The object of the present invention is to suppress a high impedance state of scan lines in a case where the scan lines are driven by using a demultiplexer. A logic AND circuit 34 outputs signals resulting from logical product of block selection signals Y-1, Y-2, and Y-3, . . . , and Y-80 and a signal Enb as address signals Ad-1, Ad-2, and Ad-3, . . . , and Ad-80. A demultiplexer 40 distributes address signals Ad-1, Ad-2, Ad-3, . . . , and Ad-80 to scan lines 112 in accordance with selection signals Sel-1, Sel-2, and Sel-3. Drains of TFTs 140 are connected to the scan lines 112. The TFTs 140 are controlled to be turned on/off, for example, by using a signal Sel-all that is a logically inverted signal of the signal Enb, and when the TFTs are turned on, level L is determined.

8 Claims, 9 Drawing Sheets

ELECTRO-OPTICAL DEVICE, SCAN LINE DRIVING CIRCUIT, AND ELECTRONIC APPARATUS

BACKGROUND

1. Technical Field

The present invention relates to technology for driving scan lines by using a demultiplexer.

2. Related Art

In electro-optical devices such as liquid crystals, pixels are provided in correspondence with a plurality of scan lines and a plurality of data lines. Each pixel has a gray scale level in accordance with a voltage value (or current value) of a data line corresponding thereto when a scan line corresponding thereto has an active level (for example, level H), and each pixel is configured to maintain the gray scale level thereafter even when the scan line has a non-active level (level L when the active level is level H). Thus, the plurality of scan lines are sequentially made to have the active level in a predetermined order, and voltages (or currents) in accordance with gray scale levels are supplied through data lines to the pixels positioned in a scan line which is made to have the active level, and thereby a target image can be displayed.

Here, a circuit that makes the plurality of scan lines to have the active level in a predetermined order is referred to as a scan line driving circuit, and generally, a shift register is used as the scan line driving circuit. Among the scan line driving circuits, a so-called peripheral circuit mounted type scan line driving circuit that is configured with same switching elements as the pixels instead of mounting an externally attachable integrated circuit has an advantage in view of improvement of production efficiency or the like by using a common manufacturing process.

However, since the shift register has a complementary type logic circuit (an inverter or a clock inverter) that combines a p-channel transistor and an n-channel transistor, when electrical characteristics are not configured as the p-channel type or the n-channel type, there is a problem that a penetration current flows.

Thus, a so-called demultiplexer type scan line driving circuit in which the scan lines are divided into blocks each having a plurality of lines (for example, three lines) and transistors (TFTs) are provided as switches in the scan lines, the blocks are sequentially selected one by one by using address signals, and switches of the plurality of scan lines belonging to the selected one block are sequentially turned on one by one by using selection signals, and thereby sequentially making the scan lines to have the active level has been proposed (for example, see JP-A-2002-169518 (particularly FIG. 1)).

However, when the above-described technology is used, a period of a high impedance (floating) state during which scan lines are not electrically connected to any part of the circuit in a non-selection period, in which the scan lines are not selected, may be relatively long. Here, in the high impedance state, when the electric potentials of the scan lines change due to a noise or the like, off-leaks in the pixels become different with each other. Accordingly, a stripe pattern in a row direction is generated on a display screen, and thereby deteriorating the display quality.

SUMMARY

An advantage of some aspects of the invention is that it provides an electro-optical device, a scan line driving circuit, and an electronic apparatus which are capable of preventing deterioration of the display quality by shortening a period during which scan lines are in a high impedance state in a case where the scan lines are driven by using a demultiplexer.

According to first aspect of the present invention, there is provided a scan line driving circuit of an electro-optical device that has a plurality of scan lines divided into blocks each having p (where p is an integer equal to or greater than two) lines, a plurality of data lines, and pixels provided in correspondence with intersections of the plurality of scan lines and the plurality of data lines and having gray scale levels in accordance with data signals supplied to the corresponding data lines in a case where logic levels of the corresponding scan lines become an active level. The scan line driving circuit sequentially selects the plurality of scan lines of the electro-optical device in a predetermined order and changes the logic level of the selected scan line into the active level. The scan line driving circuit includes: an address signal output circuit that sequentially selects the blocks one by one and supplies an address signal having the active level in a period for selecting the p scan lines belonging to the selected block to output lines corresponding to the blocks; a demultiplexer that sequentially selects the p scan lines belonging to the selected block one by one, connects the selected scan line of the selected block to an output line corresponding to the selected block, and does not connect the scan lines of the selected block, which are not selected, to the output line corresponding to the selected block; and a plurality of switches that are provided in correspondence with the plurality of scan lines, each having one end being connected to a scan line corresponding thereto and the other end being commonly grounded at a non-active logic level of the scan lines and are turned on in a part of or the whole period during which all the plurality of scan lines are not selected. According to the scan line driving circuit, a period during which the scan lines are in the high impedance state is lengthened, and a cycle of a period during which the non-active level is determined is shortened.

The address signal output circuit may include: a shift register that outputs block selection signals corresponding to the blocks, sequentially selects the blocks one by one, and makes a block selection signal corresponding to the selected block have an active level over a period during which the block is selected; and a logic circuit that limits the block selection signal to have the active level in a period during which the p scan lines corresponding to the selected block are to be selected and outputs the block selection signal as the address signal.

In addition, the address signal output circuit may includes: a shift register that outputs block selection signals corresponding to the blocks, sequentially selects the blocks one by one, and makes a block selection signal corresponding to the selected block have an active level over a period during which the block is selected, wherein the demultiplexer may start to select another scan line when a predetermined period elapses after selection of one scan line is completed.

In addition, the present invention can be implemented as an electro-optical device or an electronic apparatus having the electro-optical device along with the scan line driving circuit of an electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings.

First Embodiment

Figure 1:
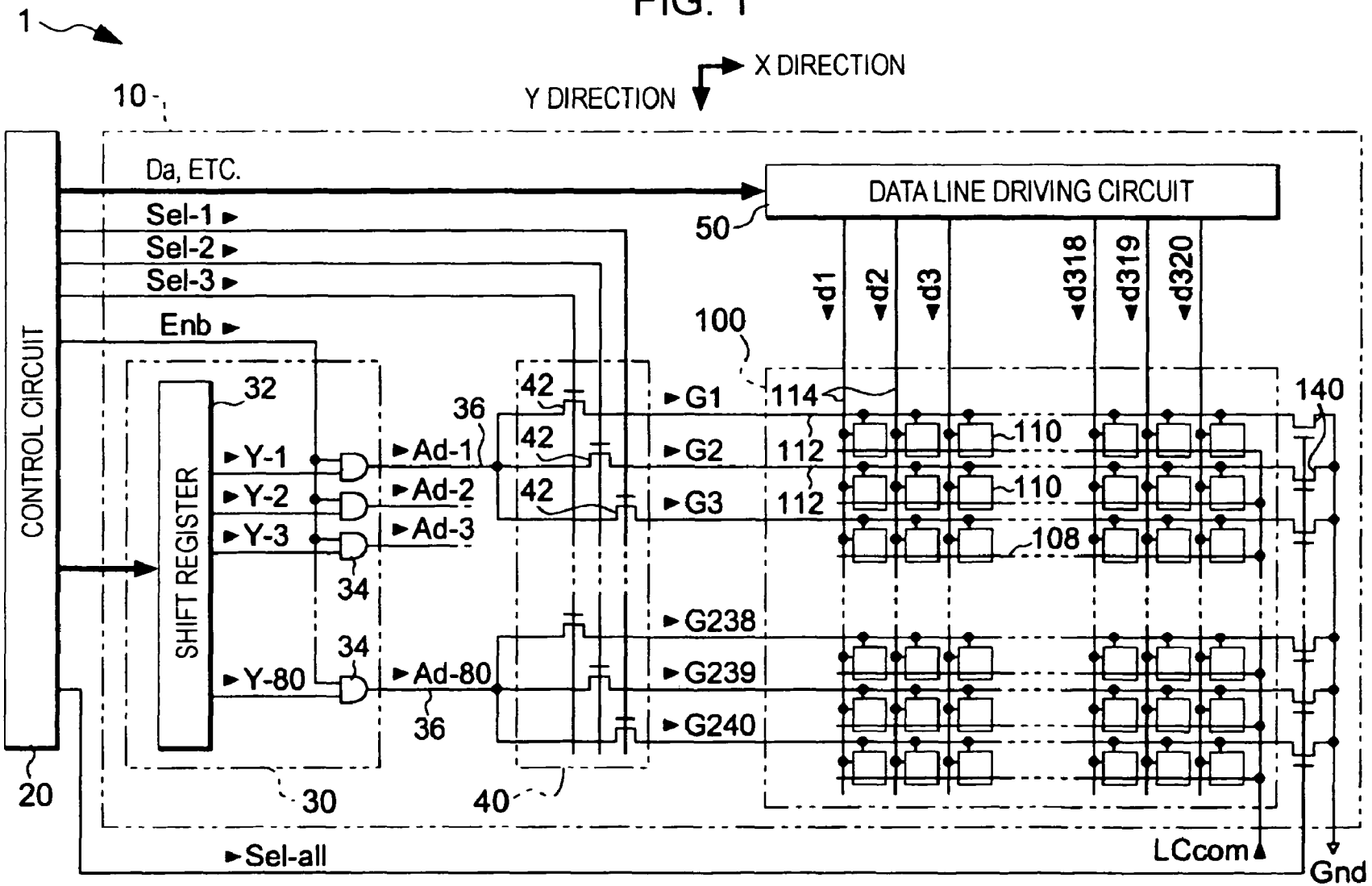
FIG. 1 is a diagram showing an electro-optical device in which a scan line driving circuit according to a first embodiment of the present invention is used.

FIG. 1 is a diagram showing the whole configuration of an electro-optical device in which a scan line driving circuit according to a first embodiment of the present invention is used.

As shown in the figure, the electro-optical device 1 is basically divided into a display panel 10 and a control circuit 20. Between these components, the display panel 10, not shown in the figure, has a configuration in which an element substrate and an opposing substrate are disposed together with a constant gap maintained therebetween such that electrode forming surfaces thereof face each other and, for example, a TN (twisted nematic) type liquid crystal is sealed in the gap.

On an element substrate of the display panel 10, elements constituting an address signal output circuit 30 and a demultiplexer 40 are formed together with TFTs of pixels, to be described later, by using one process and a data line driving circuit 50, which is a semiconductor chip, is mounted by using COG technology or the like. In addition, in the display panel 10, various control signals are supplied from the control circuit 20 to the address signal output circuit 30, the demultiplexer 40, the data line driving circuit 50, or the like through an FPC (Flexible Printed Circuit) substrate or the like.

The display panel 10 has a display area 100. According to this embodiment, in this display area 100, 240 scan lines 112 are provided so as to extend in a row direction X, and 320 data lines 114 are provided so as to extend in a column direction Y, while the scan lines and the data lines maintain electrical insulation from the scan lines 112.

In this embodiment, 240 scan lines 112 are divided into blocks each including three scan lines. Thus, the number of the scan line blocks is "80".

The pixels 110 are arranged corresponding to intersections of the 240 scan lines 112 and the 320 data lines 114. Accordingly, in this embodiment, the pixels 110 are arranged in the display area 100 so as to have a shape of a matrix having vertical 240 rows×horizontal 320 columns.

When an integer m that is equal to or greater than "1" and equal to or less than "80" is used for a generalized description of a row (scan line block) in the display area, if counted from the top of FIG. 1, the (3m−2)-th, (3m−1)-th, and (3m)-th scan lines 112 belong to the m-th scan line block.

Figure 2:
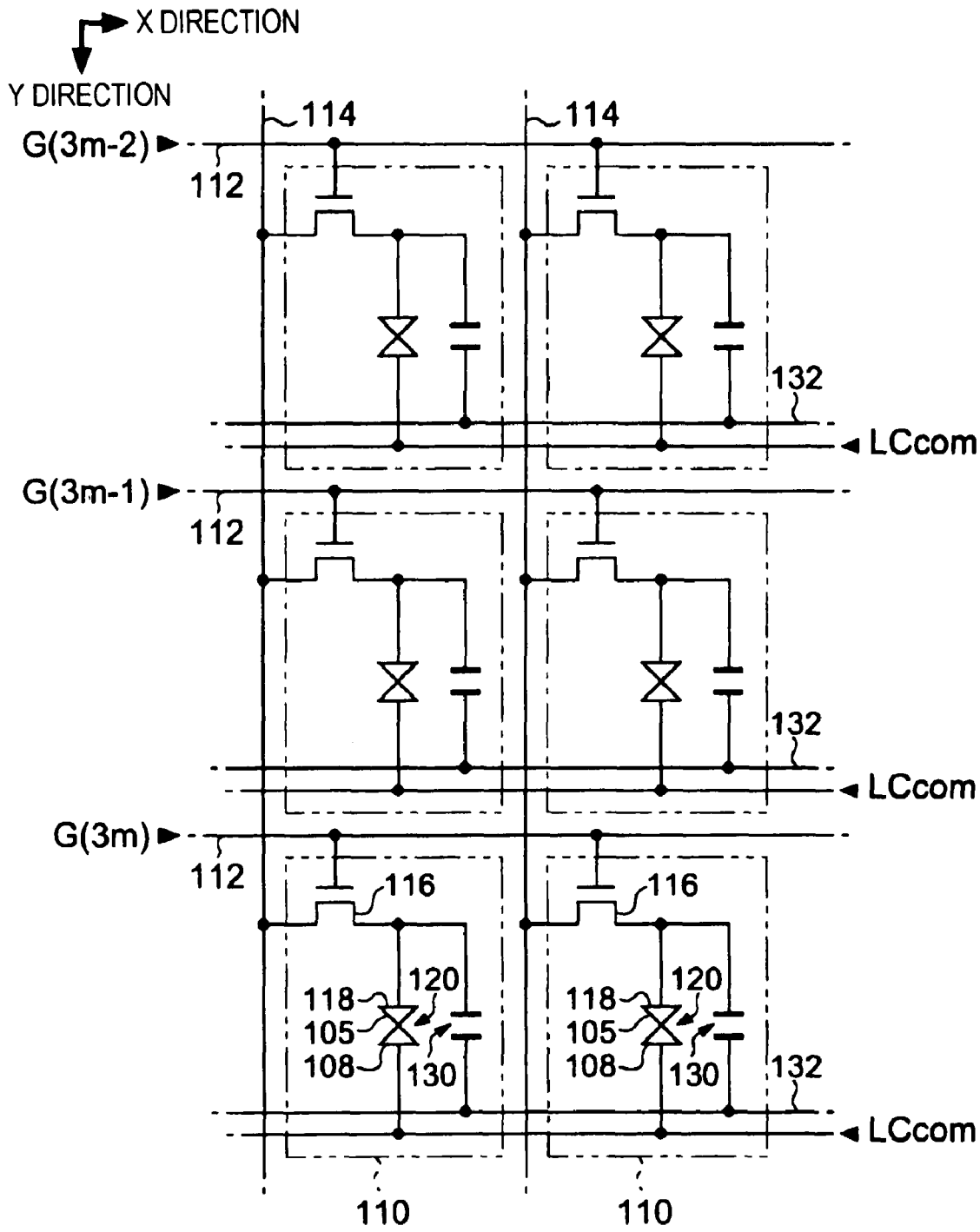
FIG. 2 is a diagram showing the configuration of pixels of the electro-optical device.

Here, the configuration of the pixels 110 will be described. FIG. 2 is a diagram showing the configuration of the pixels 110. In the figure, the configuration of total six pixels of 3×2 corresponding to intersections of the (3m−2)-th, (3m−1)-th, and (3m)-th scan lines 112 belonging to the m-th scan line block and adjacent two columns is shown.

As shown in FIG. 2, each pixel 110 includes an n-channel thin film transistor (hereinafter, abbreviated as TFT) 116 that is a switching element of a pixel, a pixel capacitor (liquid crystal capacitor) 120, and a storage capacitor 130. The pixels 110 have a same configuration with each other. Thus, when one pixel is considered, in the pixel 110, a gate electrode of the TFT 116 is connected to a corresponding scan line 112, a source electrode of the TFT 116 is connected to a corresponding data line 114, and a drain electrode of the TFT 116 is connect to a pixel electrode 118 that is one end of the pixel capacitor 120 and one end of the storage capacitor 130.

The other end of the pixel capacitor 120 is connected to a common electrode 108. The common electrode 108, as shown in FIG. 1, is common to all the pixels 110. In the embodiment, the common electrode 108 is maintained at a constant voltage value LCcom.

The other end of the storage capacitor 130 is connected to a capacitor line 132. This capacitor line 132, not shown in FIG. 1, for example, is maintained at the same voltage value LCcom as the common electrode 108. Alternatively, the capacitor line 132 may be configured to be maintained at a voltage value other than the voltage value LCcom.

The display area 100 has a configuration in which the element substrate having the pixel electrode 118 formed thereon and the opposing substrate having the common electrode 108 formed thereon are disposed together as a pair with a constant gap maintained therebetween such that electrode forming surfaces thereof face each other and a liquid crystal 105 is sealed in the gap. Thus, the pixel capacitance 120 has a configuration in which a liquid crystal 105 that is a kind of dielectric is pinched by the pixel electrode 118 and the common electrode 108 and a voltage difference between the pixel electrode 118 and the common electrode 108 is maintained in the pixel capacitance 120. In such a configuration, the transmitted light intensity of the pixel capacitance varies depending on an RMS value of the maintained voltage.

For the convenience of description, it is assumed that a normally-white mode in which the light transmittance (or light reflectance) becomes the maximum so as to display white when an RMS voltage value maintained in the pixel capacitor 120 is close to zero, the amount of transmitted light decreases as the RMS voltage value increases, and the light transmittance becomes the minimum so as to display black when the RMS voltage value reaches its maximum is used in this embodiment.

Referring back to FIG. 1, the address signal output circuit 30 outputs address signals Ad-1, Ad-2, Ad-3, . . . , and Ad-80. The address signal output circuit 30 includes a shift register 32 and logical AND circuits 34 corresponding to the scan line blocks.

Figure 3:
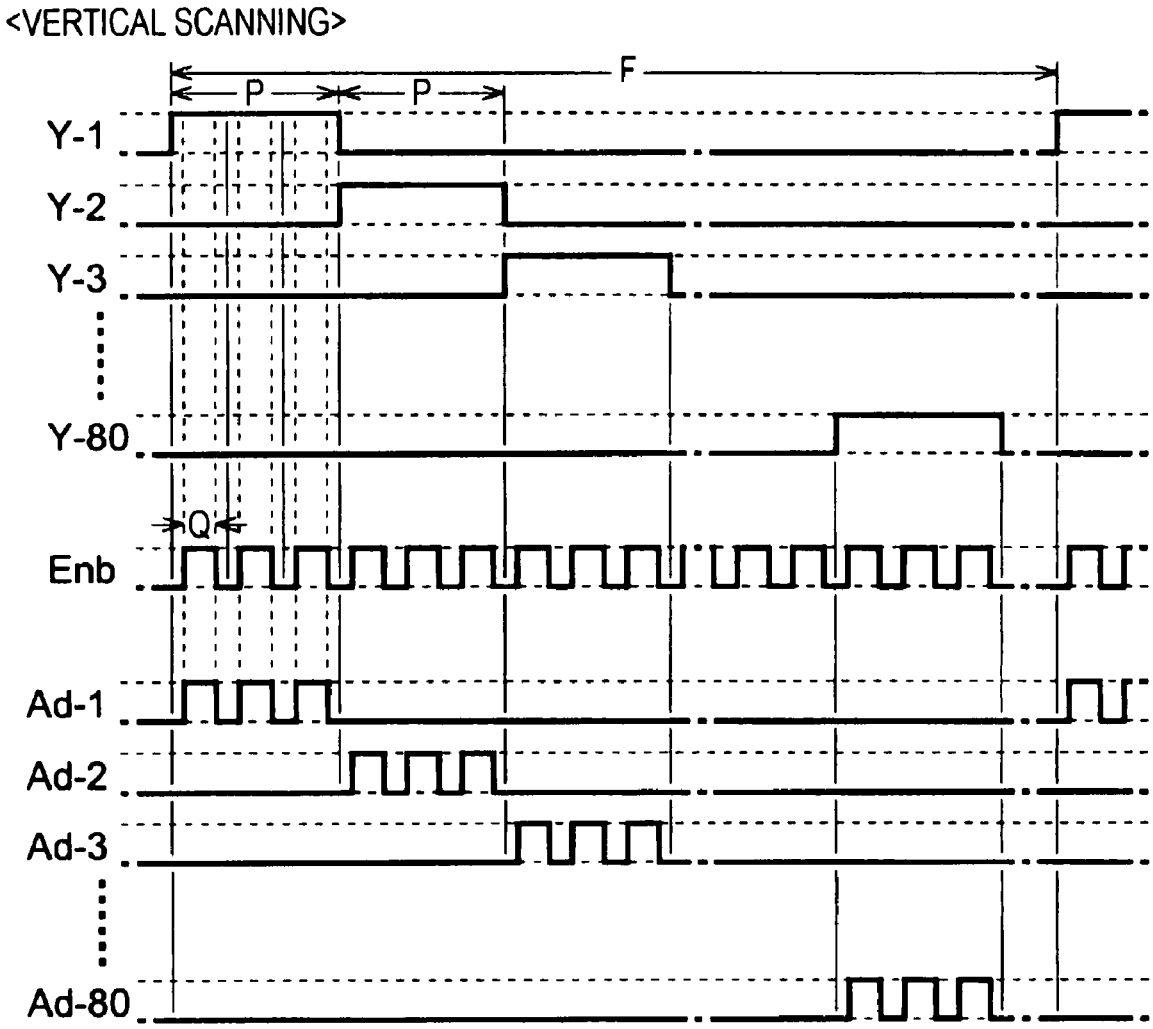
FIG. 3 is a diagram showing an operation of the scan line driving circuit.

Among these components, the shift register 32 outputs block selection signals Y-1, Y-2, Y-3, . . . , and Y-80 for sequentially selecting $1^{st}$, $2^{nd}$, $3^{rd}$, . . . , and $80^{th}$ scan line blocks in accordance with control of the control circuit 20. In particular, the shift register 32, as shown in FIG. 3, outputs the block selection signals Y-1, Y-2, Y-3, . . . , and Y-80 which sequentially become level H exclusively for a period P in the period F of one frame. Here, for the convenience of description, a block selection signal output in correspondence with an m-th scan line block is denoted as Y-m.

The logical AND circuits 34 (logic circuits) that are provided in correspondence with the scan line blocks supply signals resulted from logical product of the block selection signals and a signal Enb to output lines 36 corresponding to the blocks as address signals. For example, a logical AND circuit 34 corresponding to the m-th scan line block supplies a signal resulting from logical product of a block selection signal Ad-m and the signal Enb to an output line 36 corresponding to the m-th scan line block.

Here, the signal Enb, as shown in FIG. 3, is a pulse train that becomes level H for a period Q. The signal Enb is output three times in the period P and becomes level L at transition timings (the start and end) of any block selection signal.

Thus, the address signals Ad-1, Ad-2, Ad-3, . . . , and Ad-80, as shown in FIG. 3, respectively become three pulses resulting from extracting the block selection signals Y-1, Y-2, Y-3, . . . , and Y-80 by using pulses of the signal Enb.

The demultiplexer 40 is a collection of n-channel TFTs 42 that are provided in correspondence with the scan lines 112. Here, three TFTs 42 corresponding to the (3m−2)-th, (3m−1)-th, and (3m)-th scan lines 112 which belong to the m-th scan line block will be described representatively of the TFTs 42 for each line.

The source electrodes, which are input terminals of the three TFTs 42, corresponding to the (3m−2)-th, (3m−1)-th, and (3m)-th scan lines 112 are commonly connected to the output line 36 corresponding to the m-th scan line block. Thus, for example, to the source electrodes of three TFTs 42 corresponding to the $238^{th}$, $239^{th}$, and $240^{th}$ scan lines 112 belonging to the $80^{th}$ scan line block, an address signal Ad-80 is commonly supplied.

To gate electrodes of the three TFTs 42 corresponding to three lines belonging to the m-th scan line block, selection signals different from one another are supplied. In particular, selection signals Sel-1, Sel-2, and Sel-3 are supplied to the gate electrodes of the TFTs 42 corresponding to the (3m−2)-th, (3m−1)-th, and (3m)-th lines. In other words, when one scan line block is considered, it is configured that the selection signals Sel-1, Sel-2, and Sel-3 are sequentially supplied to the gate electrodes of the TFTs 42 of three lines which are sequentially arranged from the top in the figure.

The drain electrodes that are output terminals of three TFTs 42 corresponding to three lines belonging to the m-th scan line block are connected to terminals of the corresponding scan lines 112. Here, voltages of the $1^{st}$, $2^{nd}$, $3^{rd}$, . . . , and $240^{th}$ scan lines are denoted as G1, G2, G3, and G240.

In addition, on a scan line 112 side opposite to a demultiplexer 40 area, TFTS (switches) 140 are provided in correspondence with the scan lines 112, while the display area 100 is interposed between the scan line side and the demultiplexer area. The source electrodes of the TFTs 140 are commonly grounded at an electric potential value Gnd that is level L, the drain electrodes of the TFTs 140 are connected to the scan lines 112, and a signal Sel-all is commonly supplied to the gate electrodes of the TFTs 140.

Since the scan lines 112 are driven by the TFTs 140 together with the address signal output circuit 30 and the demultiplexer 40, the scan lines 112, the address signal output circuit 30, and the demultiplexer correspond to a scan line driving circuit according to an embodiment of the invention.

Hereinafter, the selection signals Sel-1, Sel-2, and Sel-3, and the signal Sel-all will be described with reference to FIG. 4.

As shown in the figure, the selection signals Sel-1, Sel-2, and Sel-3 have a pulse width resulting from dividing the period P by three and have a relationship with one another that phases thereof are sequentially shifted by 120 degrees. In particular, the selection signal Sel-1 becomes level H prior to the output of each first pulse in pulse trains of the address signals Ad-1, Ad-2, Ad-3, . . . , and Ad-80 and becomes level L right after the output of the each first pulse in the pulse trains. Similarly, the selection signal Sel-2 becomes level H prior to the output of each second pulse in the pulse trains of the address signals Ad-1, Ad-2, Ad-3, . . . , and Ad-80 and becomes level L right after the output of the each second pulse in the pulse trains. Similarly, the selection signal Sel-3 becomes level H prior to the output of each third pulse in the pulse trains of the address signals Ad-1, Ad-2, Ad-3, . . . , and Ad-80 and becomes level L right after the output of the each third pulse in the pulse trains.

In this embodiment, the signal Sel-all is a signal resulting from logically inverting the signal Enb.

The data line driving circuit 50 supplies data signals d1, d2, d3, . . . , and d320 having voltage values in accordance with gray scale levels of pixels 110 positioned in a scan line 112 that becomes level H of an active level to the first, second, third, . . . , and $320^{th}$ data lines 114.

Here, the data line driving circuit 50 has memory areas (not shown in the figure) corresponding to a matrix of vertical 240 rows×horizontal 320 columns. In each memory area, display data Da for designating a gray scale value (brightness) of a corresponding pixel 110 is stored. When a content for display changes, the address and display data Da to be displayed after change are supplied by the control circuit 20, and thereby the display data Da stored in each memory area is rewritten.

The data line driving circuit 50 performs an operation for reading out the display data Da of pixels 110 positioned in scan lines 112 that become level H from the memory areas, converting the display data into voltage data in accordance with the gray scale levels thereof, and supplying the converted data to the $1^{st}$ to $320^{th}$ data lines 114 positioned in the scan lines 112.

The control (block selection signals Y-1, Y-2, Y-3, and Y-80) of the address signal output circuit 30 which is performed by the control circuit 20, the signal Enb, and the selection signals Sel-1, Sel-2, and Sel-3 determine which scan lines 112 will be level H and at what timing the scan lines 112 will be level H.

Accordingly, the data line driving circuit 50, for example, can acquire which lines of display data Da are to be read out and at what timings the data signals d1, d2, d3, . . . and d320 are to be output by receiving notification of contents of the control from the control circuit 20.

The voltage value in accordance with the gray scale level described here has a positive polarity that is a voltage value higher than the voltage value LCcom applied to the common electrode 108 or a negative polarity that is a voltage value lower than the voltage value LCcom. The data line driving circuit 50 alternately changes the voltage value of a specific pixel to the positive polarity or the negative polarity, for example, for each period of one frame. The writing polarity is measured with reference to the voltage value LCcom. The voltage value, unless mentioned otherwise, is measured with reference to the ground potential Gnd of the power source, the logic level L is configured to be the ground potential Gnd, and the level H of the logic level is configured to be a voltage value Vdd.

Next, the operation of the electro-optical device will be described.

Figure 4:
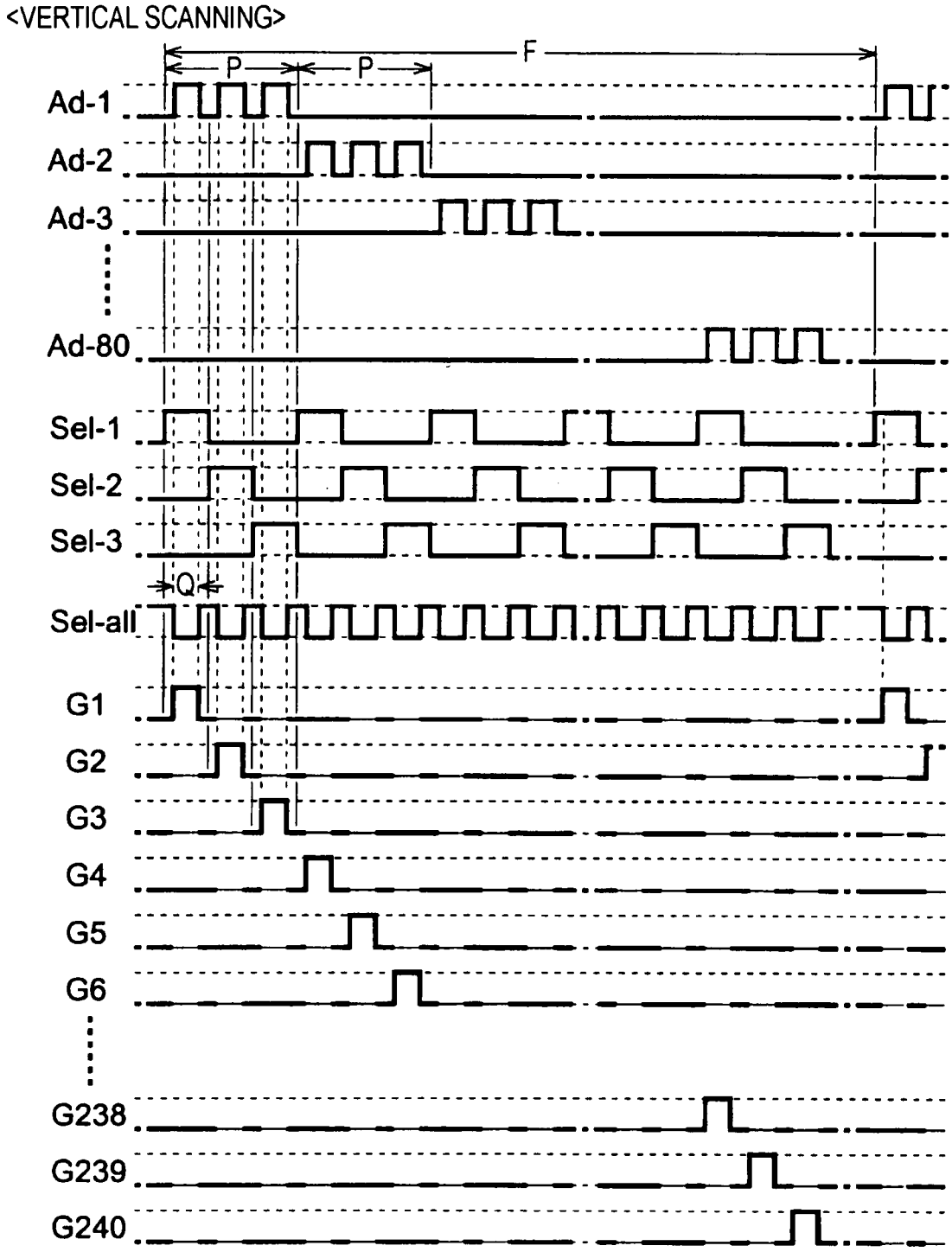
FIG. 4 is a diagram showing an operation of the scan line driving circuit.

FIGS. 3 and 4 are diagrams for describing operation flow from the shift register 32 to the demultiplexer 40.

As shown in FIG. 3, at the start of a frame, a block selection signal Y-1 corresponding to the first scan line block becomes level H. At this moment, when the signal Enb is level L, the signal Sel-all becomes level H, and thus, all the TFTs 140 are turned on, and thereby all the scan lines become level L of the ground potential Gnd. These are initial states of the voltages G1 to G240. Thereafter, the signal Sel-all becomes level L, and thereby all the TFTs 140 are turned off.

The pulse portion of the block selection signal Y-1 is extracted by using the signal Enb, and the address signal Ad-1 includes three consecutive pulses. On the other hand, all the other address signals are level L.

In a period (a period in which the address signal Ad-1 becomes level H for the first time) in which the first pulse of the address signal Ad-1 is output, as shown in FIG. 4, the selection signal Sel-1 is level H, and thereby the TFTs 42 in the first, fourth, seventh, tenth, . . . , and $238^{th}$ lines are turned on. Accordingly, the voltage G1 of the first scan line 112, as shown in FIG. 4 as a thick line, follows the voltage change of L level->H level->L level in the first pulse of the address signal Ad-1.

On the other hand, at this moment, the voltages G4, G7, G10, . . . , and G238 are determined to be level L, since the address signals Ad-2, Ad-3, Ad-4, . . . , and Ad-80 corresponding thereto are level L.

In addition, although the other scan lines, as shown in FIG. 4 as a thin line, become a high-impedance state, since the TFTs 42 corresponding thereto are turned off, level L that is a prior initial voltage state is maintained in the other scan lines due to parasitic capacitance.

Next, until the output of a second pulse is started after the output of the first pulse of the address signal Ad-1 is completed, the signal Sel-all becomes level H again, and accordingly, the voltages G1 to G240 are maintained at level L that is their initial state.

In a period (a period in which the address signal Ad-1 becomes level H for the second time) in which the second pulse of the address signal Ad-1 is output, the selection signal Sel-2 is level H, and accordingly, TFTs 42 in the second, fifth, eighth, $11^{th}$, . . . , and the $239^{th}$ lines are turned on. Thus, the voltage G2 of the second scan line 112 follows the voltage change of L level->H level->L level in the second pulse of the address signal Ad-1.

On the other hand, at this moment, the voltages G5, G8, G11, . . . , and G239 are determined to be level L, since the address signals Ad-2, Ad-3, Ad-4, . . . , and Ad-80 corresponding thereto are level L. In addition, although the other scan lines become a high-impedance state, level L that is a prior voltage state is maintained in the other scan lines due to parasitic capacitance.

Subsequently, until the output of a third pulse is started after the output of the second pulse of the address signal Ad-1 is completed, the signal Sel-all becomes level H again, and accordingly, the voltages G1 to G240 are maintained at level L that is their initial states.

In a period (a period in which the address signal Ad-1 becomes level H for the third time) in which the third pulse of the address signal Ad-1 is output, the selection signal Sel-3 is level H, and accordingly, TFTs 42 in the third, sixth, $9^{th}$, $12^{th}$, . . . , and $240^{th}$ lines are turned on. Thus, the voltage G3 of the third scan line 112 follows the voltage change of L level->H level->L level in the third pulse of the address signal Ad-1.

On the other hand, at this moment, the voltages G6, G9, G12, . . . , and G240 are determined to be level L, since the address signals Ad-2, Ad-3, Ad-4, . . . , and Ad-80 corresponding thereto are level L. In addition, although the other scan lines become a high-impedance state, level L that is a prior voltage state is maintained in the other scan lines due to parasitic capacitance.

Next, a block selection signal Y-2 becomes level H, and the above-described operations are performed for the second scan line block.

In other words, the voltages G1 to G240 are maintained again at level L that are their initial states due to the signal Sel-all that becomes level H, the voltage G4 of the fourth scan line 112 follows the voltage change of L level->H level->L level of the address signal Ad-2 in a period in which the first pulse of the address signal Ad-2 is output, the voltages G1, G7, G10, . . . , and G238 of scan lines in which the selection signal Sel-1 is input to the gate electrode of the TFT 42 thereof are determined to be level L, and the other scan lines become a high-impedance state so as to maintain their voltage values as level L that is prior voltage states.

Thereafter, the voltages G1 to G240 are maintained again at level L that are their initial states due to the signal Sel-all that becomes level H, the voltage G4 of the fifth scan line 112 follows the voltage change of L level->H level->L level of the address signal Ad-2 in a period in which the second pulse of the address signal Ad-2 is output, the voltages G2, G8, G11, . . . , and G239 of scan lines in which the selection signal Sel-2 is input to the gate electrode of the TFT 42 thereof are determined to be level L, and the other scan lines become a high-impedance state so as to maintain their voltage values as level L that is prior voltage states.

Thereafter, the voltages G1 to G240 are maintained again at level L that are their initial states due to the signal Sel-all that becomes level H, the voltage G6 of the sixth scan line 112 follows the voltage change of L level->H level->L level of the address signal Ad-2 in a period in which the third pulse of the address signal Ad-2 is output, the voltages G3, G9, G12, . . . , and G240 of scan lines in which the selection signal Sel-3 is input to the gate electrode of the TFT 42 thereof are determined to be level L, and the other scan lines become a high-impedance state so as to be maintained at level L that is prior voltage states.

The above-described operations are repeated until the operations are performed for a block selection signal Y-80, and thereby the voltages G1, G2, G3, . . . , and G240 of the $1^{st}$ to $240^{th}$ scan lines sequentially become level H exclusively.

Here, an operation for writing voltage into the pixels 110 will be described briefly. First, when the voltage G1 of the first scan line becomes H level, the data line driving circuit 50 reads out display data Da of pixels positioned at first, second, third, . . . , and $320^{th}$ columns of the first row, converts voltage values designated by the read-out display data Da into high voltage values or low voltage values relative to the voltage value LCcom, and supplies the converted voltage values to the first, second, third, . . . , and $320^{th}$ data lines 114 as data signals d1, d2, d3, . . . , and d320.

When the voltage G1 becomes level H, TFTs 116 of the pixels positioned at the first to $320^{th}$ columns of the first row are turned on, and accordingly, the data signals d1, d2, d3, . . . , and d320 are applied to pixel electrodes 118 of the TFTs 116. Thus, a difference voltage value between the data signals d1 to d320 and the voltage value LCcom are written in pixel capacitors 120 positioned at the first to $320^{th}$ columns of the first row.

Right before the voltage G2 of the $2^{nd}$ scan line becomes level H, the voltage G1 becomes level L, and thereby TFTs 116 of the pixels positioned at the first to $320^{th}$ columns of the first row are turned off, but the voltage values written in the pixel capacitors 120 are maintained by storage capacitors 130 that are connected in parallel with the pixel capacitors 120, and accordingly, the pixel capacitors 120 positioned at the first to $320^{th}$ column of the first row maintain gray scale levels in accordance with the written voltage values.

Next, the voltage G2 becomes level H. When the voltage G2 becomes H level, the data line driving circuit 50 reads out display data Da of pixels positioned at first, second, third, . . . , and $320^{th}$ columns of the second row, converts voltage values designated by the read-out display data Da into high voltage values or low voltage values relative to the voltage value LCcom, and supplies the converted voltage values to the first, second, third, . . . , and $320^{th}$ data lines 114 as data signals d1, d2, d3, . . . , and d320.

When the voltage G2 becomes level H, TFTs 116 of the pixels positioned at the first to $320^{th}$ columns of the second row are turned on, and accordingly, the data signals d1, d2, d3, . . . , and d320 are applied to pixel electrodes 118 of the TFTs 116. Thus, a difference voltage value between the data signals d1 to d320 and the voltage value LCcom are written in pixel capacitors 120 positioned at the first to $320^{th}$ columns of the second row.

Similarly, a writing operation of voltage values by using data signals is repeated until voltages G3 to G240 become level H, and thereby voltage values in accordance with gray scale levels are written in all the pixels. In the next frame, similarly the writing operation of voltage values is performed with the writing polarity being inverted. In other words, if a specific pixel is considered, when a voltage value in accordance with a gray scale level in a frame has one polarity between a high potential and a low potential relative to the voltage value LCcom, and then a voltage value in accordance with a gray scale level in the next frame becomes the other polarity between the high potential and the low potential. By performing the above-described polarity inversion operation, application of a direct-current component to the liquid crystals 105 are prevented, whereby it is possible to prevent deterioration of the liquid crystals.

Figure 5:
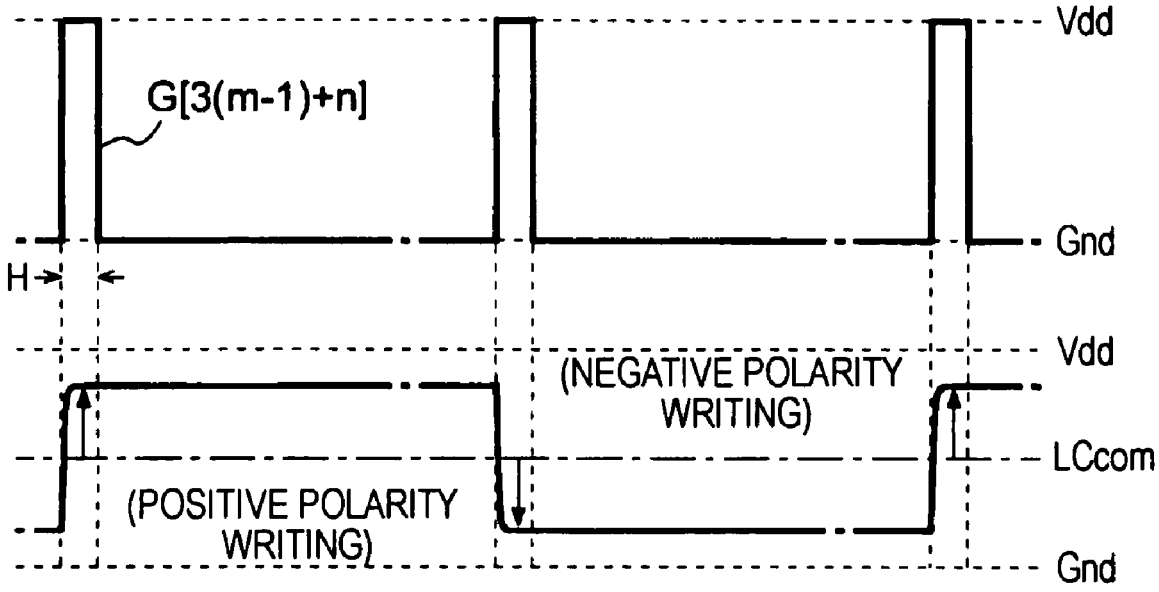
FIG. 5 is a diagram showing an operation of the electro-optical device.

FIG. 5 is a diagram showing a relationship between a voltage value of a pixel electrode 118 positioned at a column of the (3(m−1)+n)-th row and a voltage G(3(m−1)+n) of the (3(m−1)+n)-th scan line. As shown in the figure, when the voltage G becomes level H, a data signal having a voltage value higher or lower than the voltage value LCcom by a value (in the figure, denoted as ↑ or ↓) in accordance with the gray scale level of the pixel is supplied to the corresponding data line 114, and the voltage value is written in the pixel electrode 118. It is assumed that the level L of the voltage G(3(m−1)+n) is stabilized.

Figure 9:
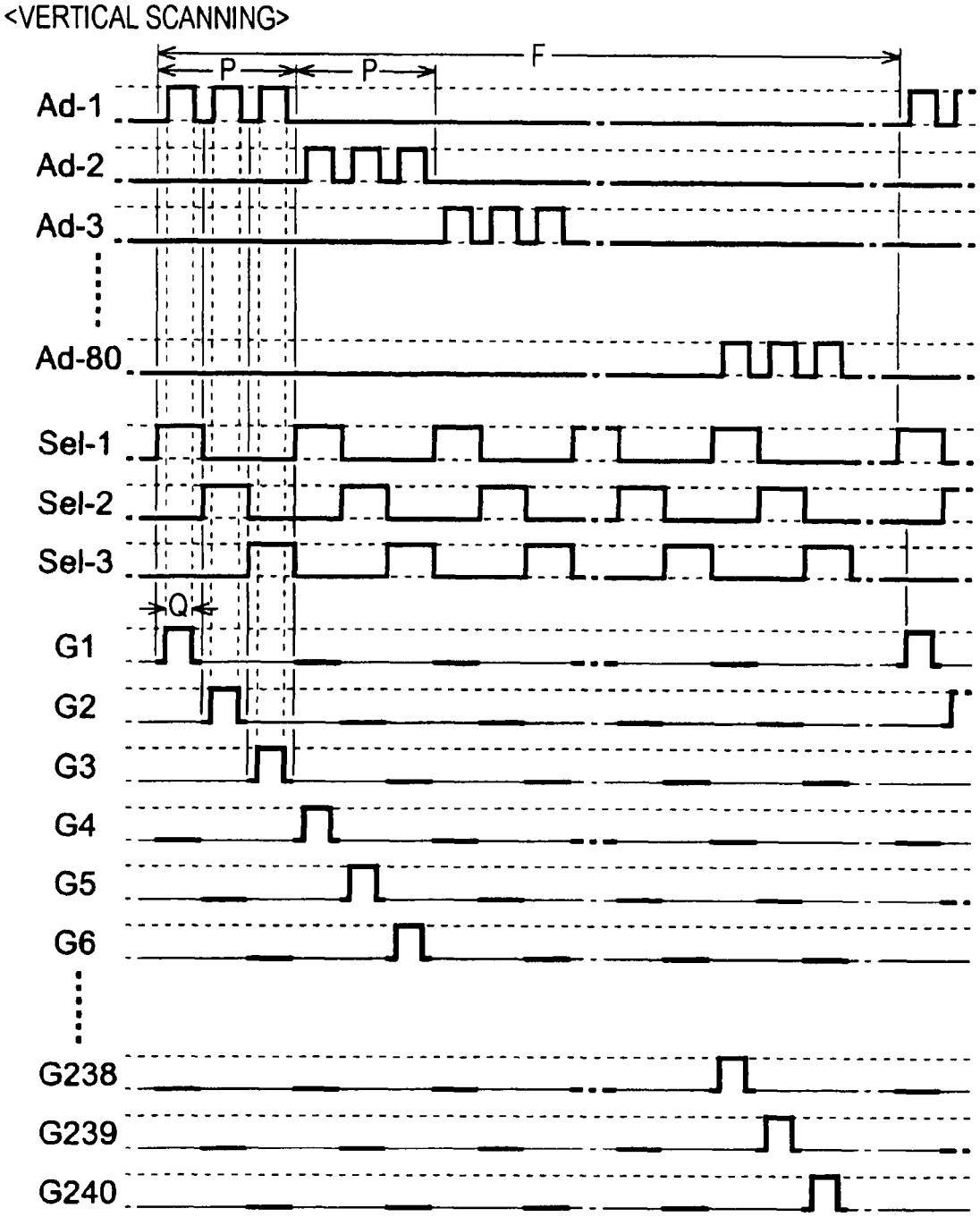
FIG. 9 is a diagram showing an operation of a comparison example of the invention.

Here, when a configuration in which TFTs 140 are not provided in the first to $240^{th}$ scan lines 112 is considered, as shown in FIG. 9, only a period of the scan lines 112 in which the TFT 42 is turned on in accordance with the selection signal is determined. The additionally determined cycle is the period P that is a cycle of the selection signal and is relatively long.

To the contrary, according to this embodiment, the TFT 42 is turned on in a period in which the signal Sel-all becomes level H in addition to the period shown in FIG. 9, and accordingly, the period in which the scan lines are in a high impedance state becomes the period Q at the most.

Thus, according to this embodiment, the high impedance state of the scan lines 112 is lengthened, and thereby it is possible to reduce an unstable voltage state and improve uniformity of level L of the scan lines 112. Thus, according to this embodiment, it is possible to suppress non-uniform display in the row direction due to different non-selection voltages of the scan lines 112.

Second Embodiment

Figure 6:
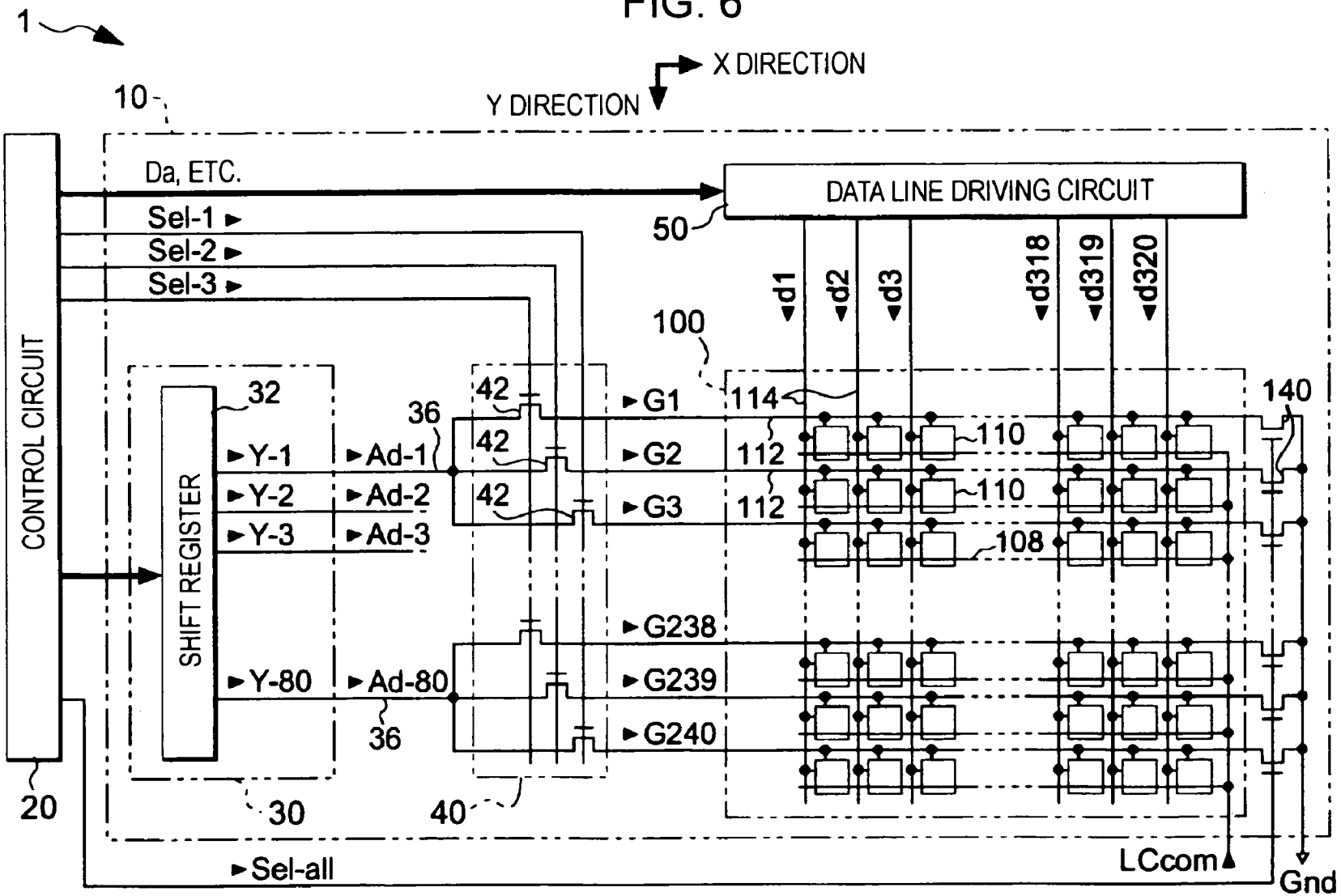
FIG. 6 is a diagram showing the whole configuration of an electro-optical device in which a scan line driving circuit according to a second embodiment is used.

Next, a second embodiment of the invention will be described. FIG. 6 is a diagram showing the whole configuration of an electro-optical device in which a scan line driving circuit according to the second embodiment is used.

As shown in this figure, in the second embodiment, a logical AND circuit 34 is not provided in the address signal output circuit 30. Thus, a configuration in which the signal Enb is not supplied and the block selection signals Y-1, Y-2, Y-3, . . . , and Y-80 output from the shift register 32 are directly output as the address signals Ad-1, Ad-2, Ad-3, and Ad-80 is used.

Figure 7:
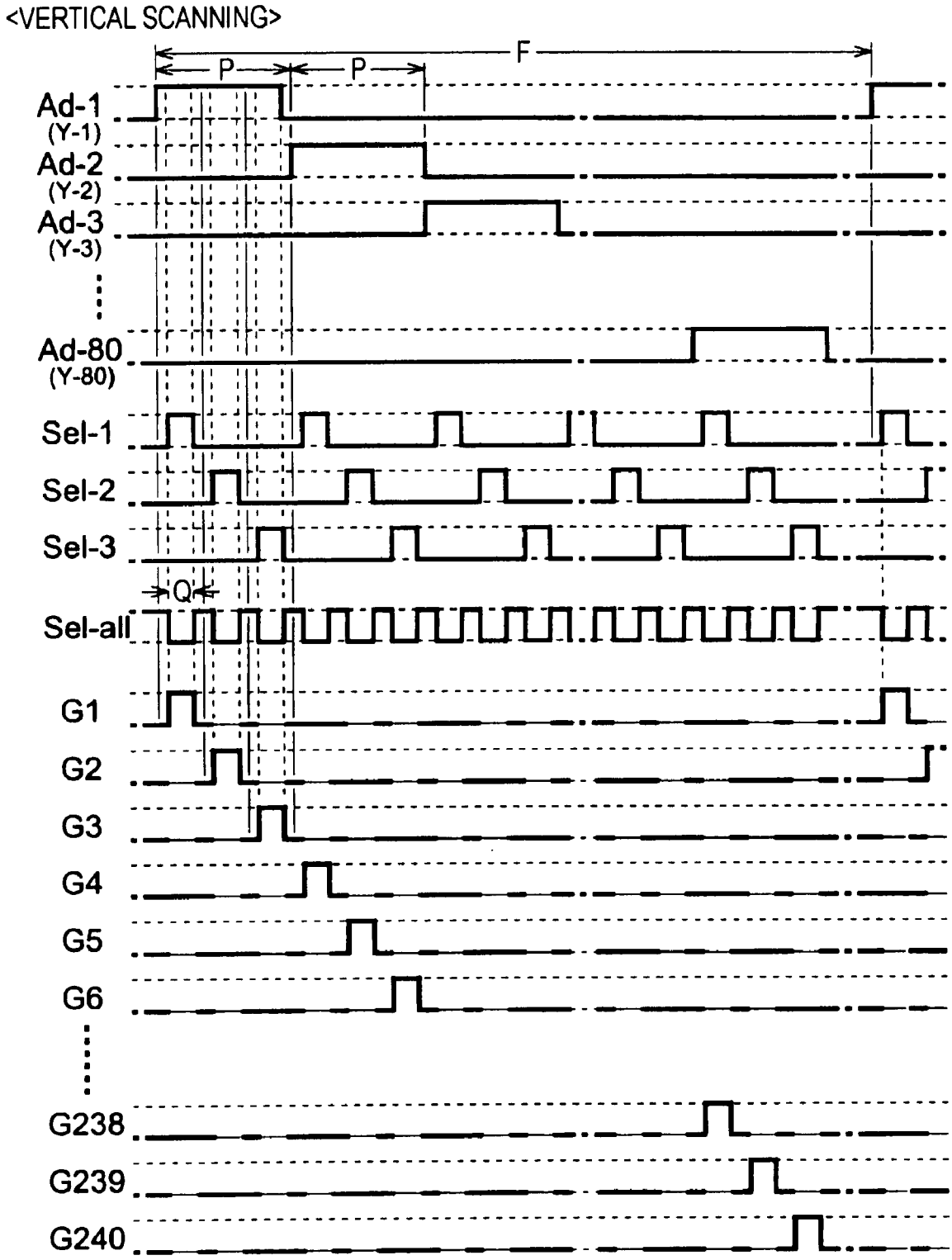
FIG. 7 is a diagram showing an operation of the scan line driving circuit.

In addition, in the second embodiment, pulse widths of the selection signals Sel-1, Sel-2, and Sel-3 are shortened, compared with those in the first embodiment (see FIG. 4), to be a period Q that is shorter than a period resulting from dividing the period P by three, as shown in FIG. 7. Accordingly, in the second embodiment, the selection signals Sel-1, Sel-2, and Sel-3 of which pulse widths are shortened serve additionally as the signal Enb. The waveform of the signal Sel-all in the second embodiment is the same as that in the first embodiment.

Thus, in the second embodiment, the logical AND circuit 34 is not required to be additionally formed on a display panel 10 in correspondence with a scan line block after non-uniform display in the row direction is suppressed, unlike in the first embodiment, and accordingly, it is possible to reduce the area that does not contribute to the display area 100.

In addition, although the signal Sel-all is a signal resulting from inverting the signal Enb in the first embodiment and the same signal is used in the second embodiment, however, the signal Sel-all may be configured to have level H in a part of a period in which the signal Enb is level L in the first embodiment and a part of a period in which all the selection signals Sel-1, Sel-2, and Sel-3 are level L in the second embodiment. In other words, the signal Sel-all is not necessarily level H over the whole the period except for a period in which any scan line become level H and may be level H in a part of the period. For example, a same effect may be exhibited even when the pulse width (period in which the Sel-all becomes level H) of the signal Sel-all is shortened.

In the above-described embodiment, although the number of the scan lines constituting a scan line block has been described as three, the number of the scan lines may be two or an integer equal to or greater than four. In addition, in the above-described embodiments, n-channel TFTs 116 are used, and thus, the active level and the non active level have been described as level H and level L, but when p-channel TFTs 116 are used, the active level and the non active level become level L and level H. When p-channel TFTs 116 are used, negative logic is applied, and thus the configuration thereof is not particularly described here.

In addition, the address signal output circuit 30 is not necessarily formed integrally with the TFTs of the pixels using a common process. For example, the address signal output circuit 30 may be formed as a semiconductor chip and mounted by using the COG technology. Furthermore, the configuration of the address signal output circuit 30, for example, may be a decoder circuit other than a shift register so as to sequentially select arbitrary address signals. In such a case, a partial display for displaying only a specific row can be performed in an easy manner.

In the above described embodiments, when a pixel capacitor 120 is considered as a unit, the writing polarity is inverted for each period of one frame. However, the reason for such an inversion is only for driving the pixel capacitor 120 using an alternating current, and accordingly, the inversion may be performed for each period of two frames or more.

In addition, although a normally-white mode is used for the pixel capacitors 120 in the above-described embodiments, however, a normally-black mode in which a dark state is activated without application of voltage may be used. The color display may be performed by configuring one dot using three pixels of R (red), G (green), and B (blue), and a configuration in which another color (for example, cyan (C)) is added thereto and one dot is configured using the four colors may be used for improving color reproducibility.

In the above descriptions, although the reference of the writing polarity is configured to be the voltage value of the common electrode 108, however, this configuration is for a case where the TFTs 116 of the pixels 110 serve as ideal switches. In practical use, a phenomenon (referred to as push-down, penetration, field-through, or the like), in which the electric potential of the drain electrode (pixel electrode 118) of the TFT 116 is lowered due to parasitic capacitance between the gate and drain electrodes at a time when the TFT 116 is turned off from a turned-on status, occurs. In order to prevent degradation of the liquid crystal, the liquid capacitor 120 should be driven by an alternating current. However, when the voltage value applied to the common electrode 108 is set as a reference for writing polarity and the pixel capacitor is driven by an alternating current, the RMS value of the voltage of the liquid crystal capacitor 120 for a negative polarity writing becomes slightly greater than that for positive polarity writing (in a case where the TFT 116 is an n-channel type) due to the pushdown. Accordingly, the reference voltage of writing polarity and the voltage value of the common electrode 108 may be differentiated, and, in particular, the reference voltage of writing polarity may be set to be higher than the voltage of the common electrode by an offset so as to offset the effect of the push down.

In addition, the potential of the other end of the storage capacitor 130 may not be fixed. In other words, the end of the storage capacitor 130 may be set as the low potential side for positive polarity writing, then switched to the high potential side, used as the high potential side for negative polarity writing, and then switched to the low potential side.

Electronic Apparatus

Figure 8:
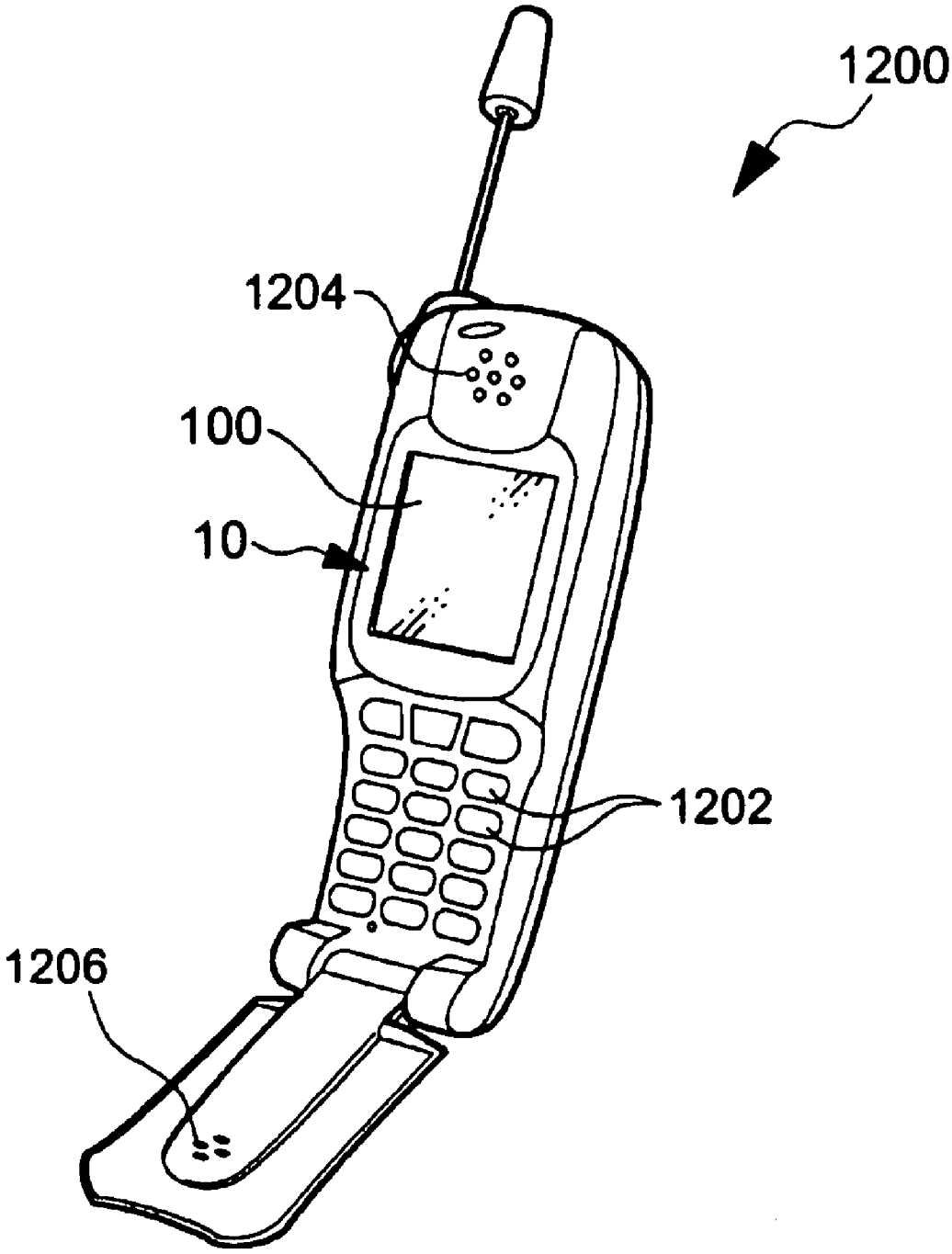
FIG. 8 is a diagram showing the configuration of a cellular phone using the electro-optical device according to an embodiment of the invention.

Next, an electronic apparatus in which the electro-optical device 1 according to the above-described embodiment is used will be described. FIG. 8 is a diagram showing the configuration of a cellular phone 1200 using the electro-optical device 1 according to this embodiment.

As shown in this figure, the cellular phone 1200 includes the above-described electro-optical device 1 in addition to a plurality of operation buttons 1202, an ear piece 1204, and a mouthpiece 1206. The constitutional elements of the electro-optical device 1 other than a portion corresponding to the display area 100 do not appear externally.

As examples of electronic apparatuses, in which the electro-optical device 1 can be used, other than the cellular phone shown in FIG. 8, there are a digital camera, a notebook computer, a liquid crystal television set, a view finder-type (or direct view-type) video cassette recorder, a car navigator, a pager, an electronic diary, an electronic calculator, a word processor, a workstation, an video telephone, a POS terminal, and a device having a touch panel. It is needless to say that an electro-optical device 1 according to an embodiment of the invention may be applied to the above-described various electronic devices.

The entire disclosure of Japanese Patent Application No. 2006-330149, filed Dec. 7, 2006 is expressly incorporated by reference herein.

What is claimed is:

1. A scan line driving circuit included in a display panel of an electro-optical device that has a plurality of scan lines divided into blocks each having p (where p is an integer equal to or greater than two) lines, a plurality of data lines, and pixels provided in correspondence with intersections of the plurality of scan lines and the plurality of data lines and having gray scale levels in accordance with data signals supplied to the corresponding data lines in a case where logic levels of the corresponding scan lines become an active level, wherein the scan line driving circuit sequentially selects the plurality of scan lines of the electro-optical device in a predetermined order and changes the logic level of the selected scan line into the active level, the scan line driving circuit comprising:

an address signal output circuit that sequentially selects the blocks one by one and supplies an address signal having the active level in a period for selecting the p scan lines belonging to the selected block to output lines corresponding to the blocks;

a demultiplexer that sequentially selects the p scan lines belonging to the selected block one by one, connects the selected scan line of the selected block to an output line corresponding to the selected block, and does not connect the scan lines of the selected block, which are not selected, to the output line corresponding to the selected block, the demultiplexer including a plurality of first switches provided in correspondence with the plurality of scan lines, the plurality of first switches being supplied with a plurality of selection signals; and a plurality of second switches that are provided in correspondence with the plurality of scan lines, each having one end being connected to a scan line corresponding thereto and the other end being commonly grounded at a non-active logic level of the scan lines and are turned on in a part of or a whole period during which all the plurality of scan lines are not selected, wherein the plurality of first switches are turned on in accordance with the selection signals and turned on in the part of or the whole period during which all the plurality of scan lines are not selected.

2. The scan line driving circuit according to claim 1, wherein the address signal output circuit includes:

a shift register that outputs block selection signals corresponding to the blocks, sequentially selects the blocks one by one, and makes a block selection signal corresponding to the selected block have an active level over a period during which the block is selected; and a logic circuit that limits the block selection signal to have the active level in a period during which the p scan lines corresponding to the selected block are to be selected and outputs the block selection signal as the address signal.

3. The scan line driving circuit according to claim 2, wherein the shift register outputs the block selection signal to the logic circuit, and the logic circuit outputs the address signal to the demultiplexer.

4. The scan line driving circuit according to claim 1, wherein the address signal output circuit includes:

a shift register that outputs block selection signals corresponding to the blocks, sequentially selects the blocks one by one, and makes a block selection signal corresponding to the selected block have an active level over a period during which the block is selected; and wherein the demultiplexer starts to select another scan line when a predetermined period elapses after selection of one scan line is completed.

5. The scan line driving circuit according to claim 1, wherein the plurality of first switches are provided on an opposite side of the pixels as the plurality of second switches.

6. An electro-optical device comprising:

a control circuit; and a display panel, wherein the display panel comprises:

a plurality of scan lines divided into blocks each having p (where p is an integer equal to or greater than two) lines;

a plurality of data lines;

pixels provided in correspondence with intersections of the plurality of scan lines and the plurality of data lines and having gray scale levels in accordance with data signals supplied to the corresponding data lines in a case where logic levels of the corresponding scan lines become an active level;

a data line driving circuit that supplies data signals in accordance with gray scale levels of pixels corresponding to the scan line that have the active level through the data lines; and a scan line driving circuit including:

an address signal output circuit that sequentially selects the blocks one by one and supplies an address signal having the active level in a period for selecting the p scan lines belonging to the selected block to output lines corresponding to the blocks, a demultiplexer that sequentially selects the p scan lines belonging to the selected block one by one, connects the selected scan line of the selected block to an output line corresponding to the selected block, and does not connect the scan lines of the selected block, which are not selected, to the output line corresponding to the selected block, the demultiplexer including a plurality of first switches provided in correspondence with the plurality of scan lines, the plurality of first switches being supplied with a plurality of selection signals, and a plurality of second switches that are provided in correspondence with the plurality of scan lines, each having one end being connected to a scan line corresponding thereto and the other end being commonly grounded at a non-active logic level of the scan lines and are turned on in a part of or in a whole period during which all the plurality of scan lines are not selected, wherein the plurality of first switches are turned on in accordance with the selection signals and turned on in the part of or the whole period during which all the plurality of scan lines are not selected.

7. An electronic apparatus comprising the electro-optical device according to claim 6.

8. The electro-optical device according to claim 6, wherein the plurality of first switches are provided on an opposite side of the pixels as the plurality of second switches.

* * * * *